US006113367A

United States Patent [19]

Dunaevsky et al.

[11] Patent Number: 6,113,367

[45] Date of Patent: Sep. 5, 2000

[54] OIL-LESS/OIL-FREE AIR BRAKE COMPRESSOR WITH A DUAL PISTON ARRANGEMENT

[75] Inventors: Valery Dunaevsky, Fairview Park; Gene Gilbert, Elyria, both of Ohio

[73] Assignee: AlliedSignal Truck Brake Systems Company, Elyria, Ohio

[21] Appl. No.: 09/382,895

[22] Filed: Aug. 25, 1999

[51] Int. Cl.[7] ..... F04B 7/00

[52] U.S. Cl. ..... 417/515; 417/521; 92/151; 92/165 R

[58] Field of Search ..... 417/521, 515, 417/399; 92/151, 165 R

[56] References Cited

U.S. PATENT DOCUMENTS

| | | | |
|---|---|---|---|
| 354,563 | 12/1886 | May | 92/86.5 |
| 665,222 | 1/1901 | Isler | 417/534 |
| 924,098 | 6/1909 | Cole | 417/513 |
| 1,031,528 | 7/1912 | Cole | 91/533 |
| 1,447,514 | 3/1923 | Jorgensen | 417/536 |
| 2,034,069 | 3/1936 | Walti | 417/516 |
| 2,972,898 | 2/1961 | Hartel | 74/105 |
| 3,187,730 | 6/1965 | White | 123/71 R |
| 3,196,618 | 7/1965 | Farmery et al. | 92/5 R |
| 3,485,141 | 12/1969 | Ott et al. | 91/533 |
| 4,759,260 | 7/1988 | Lew | 91/394 |

OTHER PUBLICATIONS

"Friction Temperature Generted by a Piston Ring in a Reciprocating Oil–less Air Brake Compressor", Dunaevsky, V. and Kudish, I., Nov. 16–18, 1998.

*Primary Examiner*—Charles G. Freay
*Assistant Examiner*—Robert Z. Evora

[57] ABSTRACT

A cylinder is divided into two chambers by a wall to receive a pair of pistons. This reduces the stroke length and correspondingly reduces the linear speed of the piston. This leads to a reduced PV factor associated with degradation and wear of the piston rings. Moreover, the multi-cylinder arrangement provides the same performance in an oil-free compressor assembly without appreciably expanding dimensional constraints relative to known systems.

11 Claims, 3 Drawing Sheets

OIL-LESS/OIL-FREE AIR BRAKE COMPRESSOR WITH A DUAL PISTON ARRANGEMENT

BACKGROUND OF THE INVENTION

1. Field of the Invention

This invention relates to compressors used in heavy vehicle braking systems. More particularly, the application is directed to an oil-less/oil free air compressor.

2. Discussion of the Art

Air compressors are used in brake systems to provide and maintain air under pressure to operate the vehicle brakes and any auxiliary air systems. The compressor is engine driven and typically is a two cylinder, single stage, reciprocating compressor. A connecting rod extends from the engine driven crankshaft and is operatively connected to a piston that reciprocates in an associated bore to compress the air in the bore and provide pressurized air to the brake system/auxiliary air system.

The vehicle engine provides a continuous supply of oil to the compressor. The oil is routed from the engine to an oil inlet of the compressor to maintain lubrication of connecting rod and crankshaft bearings, piston rings and other dynamic components. The pistons typically include a plurality of piston rings to seal with the bore wall. For example, commercial arrangements usually employ five (5) piston rings that, although seal the compression chamber, do not inhibit sufficiently oil thrown from the crankshaft from entering into and contaminating the air brake system.

A parameter PV is usually associated with heat flux imposed by the rubbing surfaces of compressors. A PV factor identifies the severity of wear associated with the rubbing components. In connection with piston rings, a PV factor is recognized as a product of average per cycle gas pressure (represented, e.g., in pounds per suare inch (psi)) multiplied by the average ring velocity in the reciprocating motion (expressed, e.g., in feet per minute (fpm)). By way of example only, a typical air brake compressor has a PV factor in the range of 32,000 psi-fpm. The PV factor is one indicator of the wear of the piston rings. The less the PV factor, the less severe is wear and the operation is improved.

It is known that reducing the length of the stroke of the piston would, in turn, reduce the linear speed of the piston and thus have an impact on the PV factor. However, this would necessitate larger pistons or more pistons to compensate for a reduced amount of compressed air. The dimensions of the system that accommodate the air compressor do not permit the mere addition of similar pistons or substitution with a larger piston. Thus, a need exists to convert the compressor system into a multi-cylinder system without appreciably expanding the dimensions of the original compressor arrangement.

Piston rings of the oil-less/oil-free compressors are usually constructed from polymeric materials that are subject to degradation at elevated temperatures. Thus, a continued need exists to reduce the heat imposed on the piston rings to maximize the useful life of the ring.

SUMMARY OF THE INVENTION

The present invention provides an oil-less/oil-free and lubricated compressor that meets the above needs and others in a simple, economical manner.

More particularly, the invention provides an air compressor, for supplying air to a vehicle brake system, comprised of a cylinder divided into multiple chambers, each chamber having its own piston. The pistons are mechanically interconnected to move in unison. The multiple pistons provide the same effective cylinder diameter where each piston has a reduced stroke length which results in a reduced PV factor for the piston rings.

According to a proposed embodiment, air discharge and intake occur simultaneously in both tandem cylinders. That is, air is discharged from one side of the chambers at the same time it is entering the other side of the chambers and, likewise, intake air enters the one side of the chambers while it is discharged from the other side of the chambers at the other end of the stroke.

The chambers are of substantially equal volume and because of the interconnection through the mechanical linkage, the pistons move in tandem.

A primary benefit of the subject invention resides in the reduction in wear inducing conditions imposed on the compressor assembly of the oil-less/oil-free compressors.

Another benefit of the invention is in the field of oil carry over reduction in lubricated compressors. Experience shows that the shorter stroke compressors pass less oil.

Still another benefit of the invention relates to the ability to use a proposed concept of shorter stroke compressor without appreciably expanding the dimensions of the compressor.

Still another advantage is realized by elimination of oil as a lubricant (in oil-less compressors)and the associated potential for contamination of the air brake system.

Still other features and benefits of the invention will become apparent to those skilled in the art upon reading and understanding the following detailed description.

DETAILED DESCRIPTION OF THE PREFERRED EMBODIMENTS OF THE INVENTION

Figure 1:
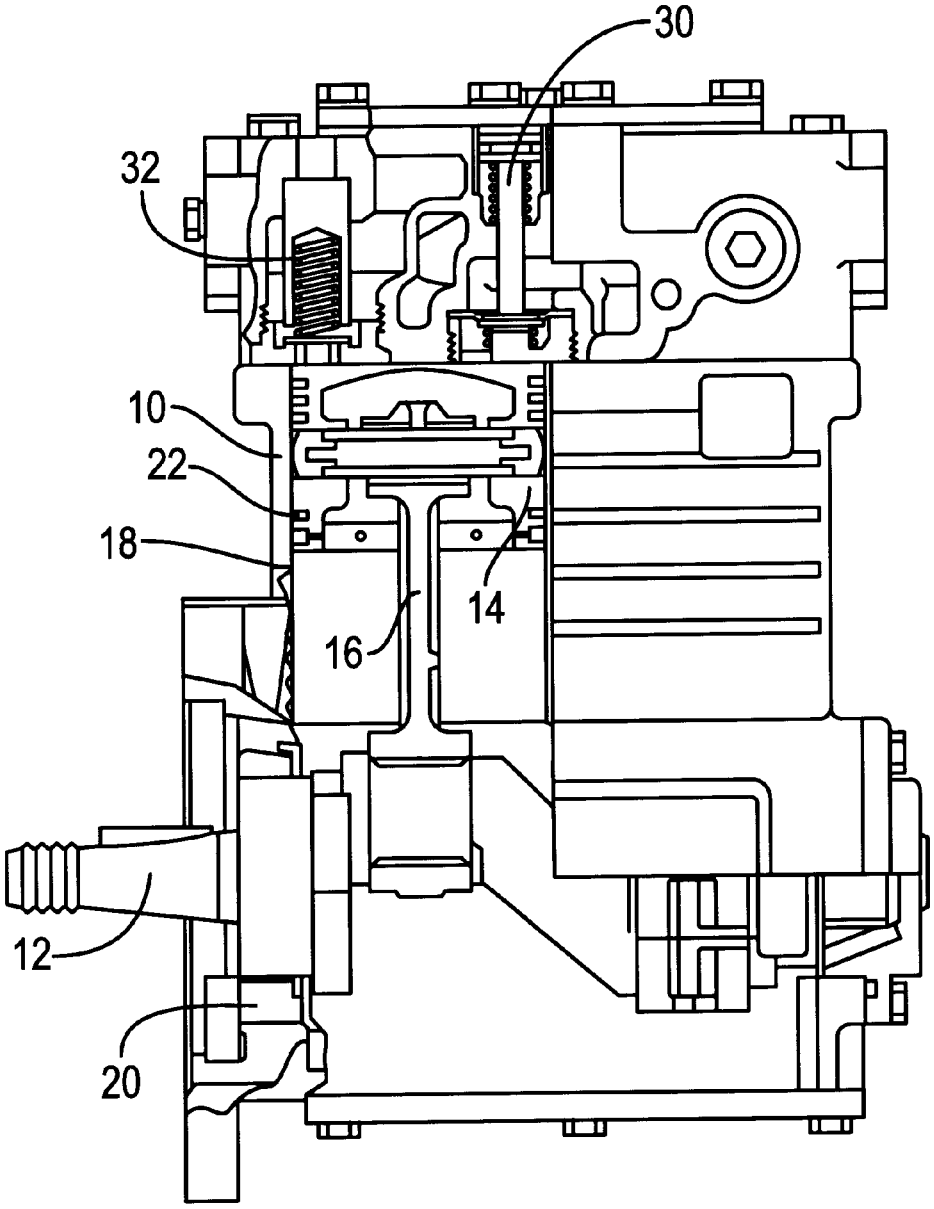
FIG. 1 (PRIOR ART)
FIG. 1 is longitudinal partial cross-sectional view of a conventional air compressor used in a heavy vehicle braking system.

Turning first to FIG. 1, and by way of introducing common terms used in the following description of the preferred embodiments of the invention, a conventional two cylinder, single stage, reciprocating compressor is illustrated and identified as prior art. A crankcase 10 houses the crankshaft 12, pistons 14 (only one of which is shown in cross-section), connecting rod 16, cylinder bore 18, and main bearings 20. As is known, the piston includes piston rings 22 on the peripheral surface thereof adapted to sealingly engage the internal wall defining the cylinder bore. The crankshaft is driven by the vehicle engine and typically operates in a continuous mode when the engine is running. Actual compression of air, however, is controlled by the compressor unloading mechanism and the governor (not shown).

During a downstroke of the piston, inlet valve 30 opens to draw atmospheric air into the cylinder or chamber. As the piston begins its upward stroke, the inlet valve closes and the air is compressed and eventually pushes the discharge valve 32 from its seat and delivers compressed air to the system. The assembly is designed so that as one piston compresses, the other chamber is receiving air during its downstroke.

A continuous supply of oil is provided to the compressor and lubricates the connecting rod crankshaft bearings. A spill of oil from the bearings lubricates other dynamic components of the compressor. Air flow through the engine compartment, as well as movement of the vehicle, assists in cooling the compressor. Coolant flowing from the engine's cooling system is also preferably provided to the compressor head to maintain discharge air temperatures within a desired range. Since these aspects of the structure are conventional, further discussion herein is deemed unnecessary to a full and complete understanding of the present invention.

Figure 3:
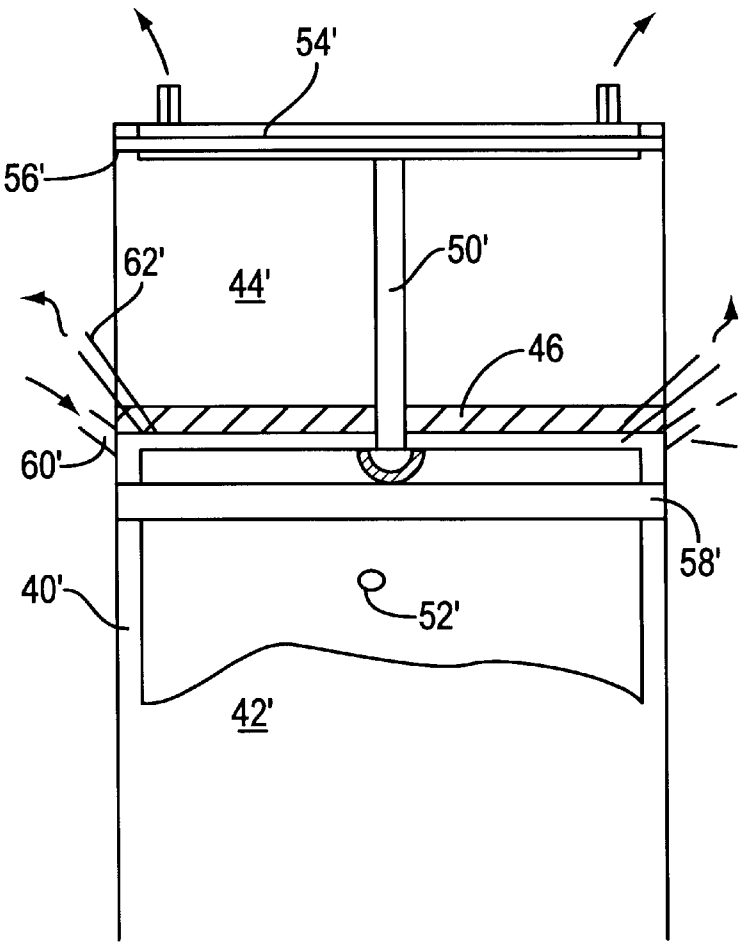
FIG. 3 is a schematic cross-sectional representation of a preferred embodiment of the present invention during an upstroke.
Figure 2:
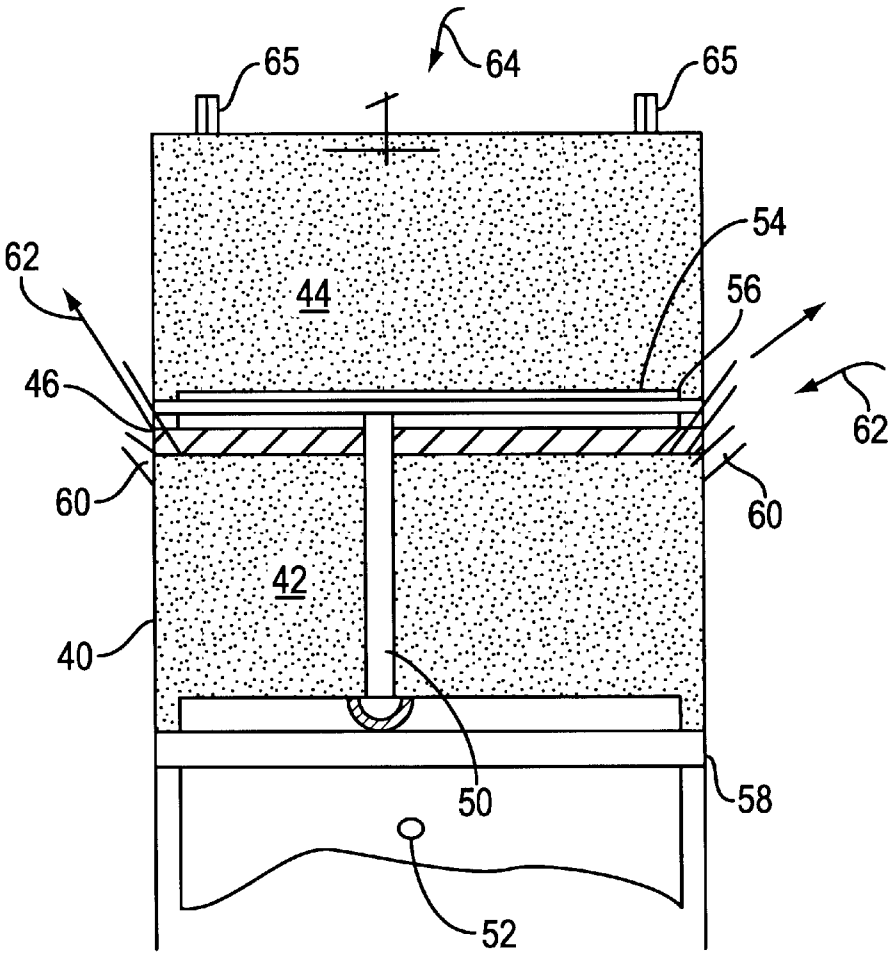
FIG. 2 is a schematic cross-sectional representation of a preferred embodiment of the present invention during a downstroke.

Turning now to FIGS. 2 and 3, and as described in the Background, PV factor is related to the severity of the wear inducing conditions experienced by piston rings. Since this is directly related to the average ring velocity resulting from reciprocating motion of the piston (as expressed in feet per minute (fpm)), the subject invention reduces the stroke length of the piston to reduce PV by approximately fifty percent (50%) without reducing performance. To accomplish this objective, cylinder 40 is divided into first and second compartments or chambers 42, 44 by a wall 46 shown as a diaphragm. The wall has an opening adapted to closely receive a mechanical linkage assembly or rod 50 therethrough. The rod mechanically interconnects a first or lower piston 52 to a second or upper piston 54. Preferably, the volumes of the two chambers 42, 44 are substantially equal and, when added together, are equal to the original volume of a non-sectioned cylinder, i.e., the equivalent of the cylinder shown in FIG. 1. The cylinder diameter is also substantially the same as that in FIG. 1 because of the dimensional constraint imposed by the environment where the compressor is mounted in the vehicle.

It will also be appreciated that the second piston 54 has a reduced height and has a piston ring 56 that sealingly engages the cylinder wall. Likewise, piston 52 includes a single piston ring 58 that sealingly engages the cylinder wall. In a preferred arrangement, the piston rings have a generally U-shaped cross-section so that friction with the sidewall is reduced during the intake stroke, i.e., the U-shape collapses during the intake stroke. On the other hand, during the compression stroke, the U-shaped configuration expands to provide a desired increased seal interface with the cylinder wall. A preferred material of construction of the piston ring is a PTFE based material that, in connection with ring design, reduces the number of rings when compared to the prior arrangements.

Openings 60 and 64 associated with the chambers 42 and 44, respectively, allow intake air to enter these chambers during downstroke of the compressor (FIG. 2). Conversely during the upward stroke compressed air is discharged from both chambers through openings 62 and 65.

No seal is required between the crankcase and the cylinders. Since oil carry over is eliminated in oil-less and oil-free compressors, and oil carry over is reduced in the lubricated short stoke compressors, the potential for contaminating the rest of the air brake system is also substantially reduced. This limits the potential number of customer returns for service.

Additionally, the reduced number of rings lowers the horsepower drawn on the piston/cylinder assembly. Moreover, the new arrangement is far simpler and less expensive since the oil supply is eliminated. The piston rings are not subject to the same degradation problems since the piston rings encounter a reduced linear speed because of the reduced stroke length. Reduced friction and reduced temperature generation, in turn, reduces the need for cooling of the cylinders. It will be appreciated, however, that cooling of the head can still be modified to use the air to effectively cool the cylinder. For example, since the intake air passages can now extend alongside the cylinder, instead of just being on the top of it as in the prior arrangements, the air passages can be effectively routed to also serve a heat transfer function for the cylinder. Accordingly, all of these advantageous features and benefits are associated with the modification to a two-chamber arrangement that is equal to the original volume of the prior art.

Figure 4:
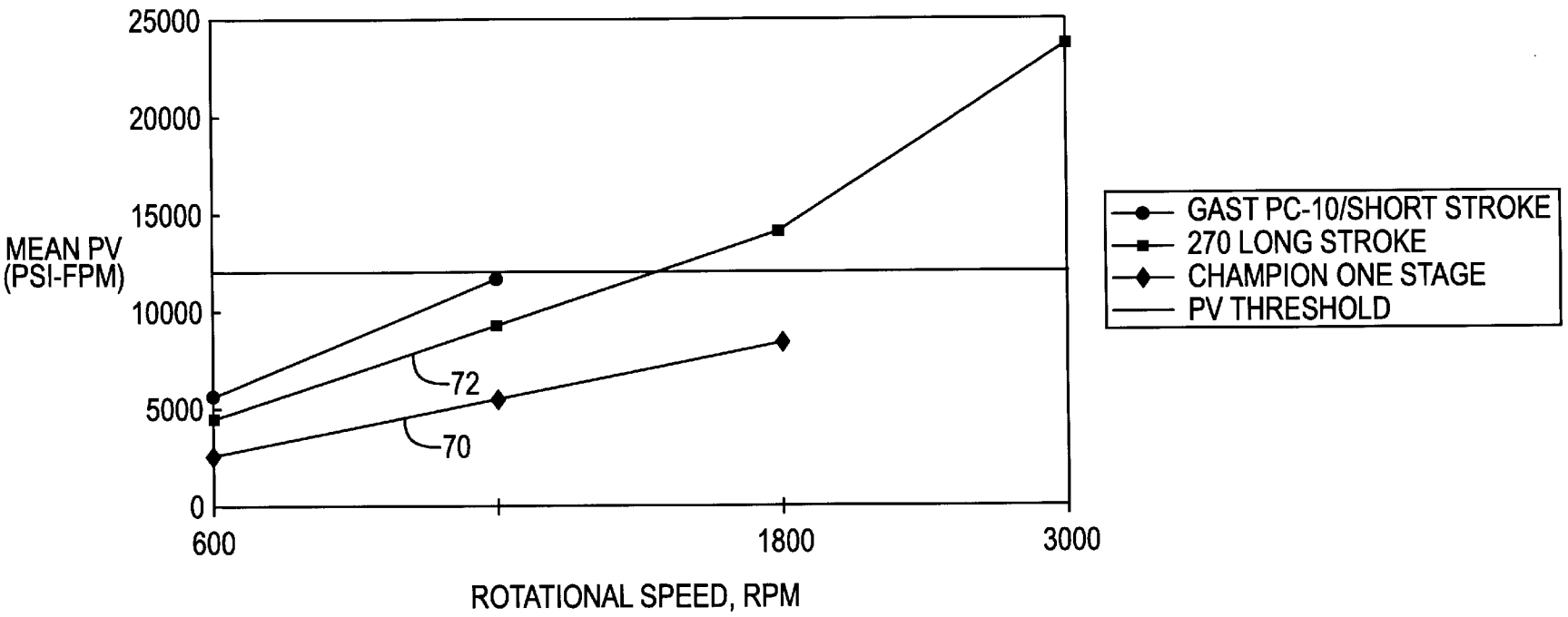
FIG. 4 is a graphical representation of the PV factors associated with the teachings of the present invention.

FIG. 4 graphically represents the reduced PV factor associated with the present invention. The oil-less compressor of the present invention represented by line 70 has a reduced PV approximately fifty percent (50%) less when compared to the prior arrangement (line 72), without any loss in performance.

The invention has been described with reference to the preferred embodiment. Obviously, modifications and alterations will occur to others upon a reading and understanding of the detailed description. For example, different piston configurations can be used. Alternatively, the arrangement can be modified so that one of the chambers is undergoing compression on the upstroke and the other chamber is compressed on the downstroke—although this modification is not deemed as desirable as the preferred embodiment described above. Moreover, the universal connection between the interconnecting rod 50 and the first and second pistons could be modified as deemed necessary. Likewise, alternative materials could be used. The illustrated embodiment shows a pair of pistons, although it is contemplated that a greater number of pistons could be used by merely duplicating the structural arrangement described above. The invention is intended to include all such modifications and alterations insofar as they come within the scope of the accompanying claims and the equivalents thereof.

Having thus described the preferred embodiment, the invention is now claimed to be:

1. A reciprocating oil-less compressor for supplying air to an air-actuated vehicle brake system, the reciprocating oil-less compressor including:

a piston and cylinder assembly including:

a cylinder divided along its longitudinal axis into a plurality of compression chambers, wherein said compression chambers are separated by a wall, the cylinder including:

a first compression chamber;

a second compression chamber; and, an air sealable passage in the wall separating adjacent compression chambers of the cylinder; and, a first piston moveable in the first compression chamber, a rod connected to the first piston and adapted to connect the first piston to an external power source;

a second piston moveable in the second compression chamber; and a mechanical linkage connecting the first piston to the second piston in the adjacent cylinder compression chamber;

the piston and cylinder assembly further includes:

an air inlet for each compression chamber in the piston and cylinder assembly, and an air discharge for each compression chamber in the piston and cylinder assembly.

2. The oil-less compressor of claim 1 wherein a piston ring is associated with each of the first and second pistons and is positioned in an annular groove on each piston.

3. The oil-less compressor of claim 1 wherein the plurality of compression chambers in the cylinder are of substantially equal volume.

4. The reciprocating oil-less compressor of claim 1 wherein the air sealable passage in the wall separating adjacent compression chambers of the cylinder enables the mechanical linkage between pistons in adjacent cylinder compression chambers to freely move between first and second positions.

5. The reciprocating oil-less compressor of claim 1 wherein the first piston and second piston, through a mechanical linkage, move in tandem between first and second positions in their respective cylinder compression chambers.

6. The reciprocating oil-less compressor of claim 1 wherein the piston and cylinder assembly further includes a plurality of additional compression chambers in the cylinder, a plurality of additional pistons slidably and sealingly mounted in each additional compression chamber, and mechanical linkages, between each additional piston in consecutive cylinder compression chambers along the longitudinal axis of the cylinder, connecting said additional pistons to each other.

7. The reciprocating oil-less compressor of claim 6 wherein the plurality of additional pistons, through said mechanical linkages, move in tandem with the first piston and with each other between first and second positions in their respective cylinder compression chambers.

8. The reciprocating oil-less compressor of claim 1 wherein the cylinder head assembly further includes an air inlet valve for each compression chamber in the piston and cylinder assembly, and an air discharge valve for each compression chamber in the piston and cylinder assembly.

9. The reciprocating oil-less compressor of claim 8 wherein the plurality of air inlet valves provides separate control of inlet air for each compression chamber in the piston and cylinder assembly.

10. The reciprocating oil-less compressor of claim 9 wherein the plurality of air intake valves, the plurality of air discharge valves, and the plurality of pistons within the cylinder compression chambers operate such that intake and compression/discharge cycles of each compression chamber are simultaneous in a parallel mode of operation.

11. A reciprocating lubricating compressor comprising a piston and cylinder assembly including:

a cylinder divided into a plurality of compression chambers separated by a wall between each compression chamber, a piston received in each compression chamber and the pistons are mechanically interconnected with one another through the wall, and one of the pistons including a rod adapted to connect the pistons to an external power source;

the piston and cylinder assembly firer includes:

an air inlet for each compression chamber in the piston and cylinder assembly, and an air discharge for each compression chamber in the piston and cylinder assemble.

* * * * *